US005236820A

United States Patent [19]

Depra et al.

[11] Patent Number: 5,236,820

[45] Date of Patent: Aug. 17, 1993

[54] TABULAR GRAIN PHOTOSENSITIVE ELEMENTS COMPRISING TITANIUM CARBOXYL COMPOUNDS

[75] Inventors: Patricia A. Depra, Etowah; Kathleen D. Moguel, Brevard, both of N.C.; Michael P. Keyes, Fairport, N.Y.

[73] Assignee: E. I. Du Pont de Nemours and Company, Wilmington, Del.

[21] Appl. No.: 944,912

[22] Filed: Aug. 21, 1992

[51] Int. Cl.[5] ..... G03C 1/035; G03C 1/30

[52] U.S. Cl. ..... 430/567; 430/623

[58] Field of Search ..... 430/567, 623; 106/125

[56] References Cited

U.S. PATENT DOCUMENTS 2,989,417 6/1961 Overman ..... 430/621
4,119,464 10/1978 Sauerteig et al. ..... 430/623
4,609,479 9/1986 Smeltz ..... 252/8.551
4,953,621 9/1990 Putzig et al. ..... 252/8.551
4,996,336 2/1991 Putzig et al. ..... 556/55

*Primary Examiner*—Janet C. Baxter

[57] ABSTRACT

A photographic element is described which has improved image color due to inclusion of titanium complexes of the formula:

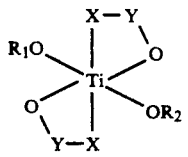

1Z wherein the substituents have specific definitions.

6 Claims, No Drawings

TABULAR GRAIN PHOTOSENSITIVE ELEMENTS COMPRISING TITANIUM CARBOXYL COMPOUNDS

FIELD OF THE INVENTION

This invention relates to a photographic element. More specifically this invention relates to the use of titanium complexes in combination with tabular grains in a photographic element and the improvements derived therefrom.

BACKGROUND OF THE INVENTION

Photographic elements have long been known to utilize tabular silver halide grains comprising parallel faces. These grains provide many advantages including improved covering power and reduced silver coating weight as compared to conventional cubic or polymorphic grains. One particular disadvantage of tabular grains is the propensity to form thin silver filaments upon development. The filaments diffract light and impart a yellow color to the developed silver which makes the imaged silver appear brown instead of the aesthetically pleasing black. It has long been a desire in the art to provide a photographic element which takes full advantage of tabular grains without the inherent brown image color.

Titanium complexes are taught in the art as a means for crosslinking a hydrophilic colloid such as gelatin. Teachings in the art provide for the use of titanium complexes in concentrations of 1–40% by weight relative to the weight of the gelatin. At these levels titanium complexes are taught to improve hardening as measured by the melting point of the gelatin. Amounts approaching a minimal of 1% are not sufficient to increase hardening, as measured by melt points, and amounts over 40% provide minimal additional advantage. Therefore, it has not been considered advantagous in the art to utilize titanium complexes in small amounts since the expected benefit of improved hardening of the gelatin are not observed.

SUMMARY OF THE INVENTION

It is an object of this invention to provide a photographic element wherein the growth of elemental silver during processing is improved. Improved growth of elemental silver is observed by an improved darkening of the elemental silver or a decrease in the yellow component of the light reflected off of the elemental silver. These and other improvements are provided in a photographic element comprising;

(a) at least one silver halide photosensitive layer comprising tabular grains;

(b) a hydrophilic colloid;

(c) at least one titanium complex in the amount of 0.0001 to 1.0 grams per 100 grams of said hydrophilic colloid wherein said titanium complex is defined as

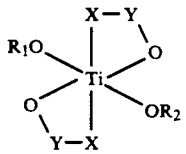

1Z wherein $R_1$, $R_2$ independently represent H, an alkyl group of 1 to 10 carbons, $$-CH_2(CHOH)_nCH_2-R_3$$

or

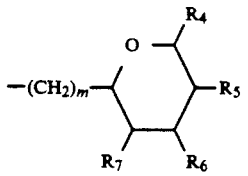

Y is a linear bridging group of 2 to 6 carbons;
X is O or N;
Z is $(NR_9R_{10}R_{11}R_{12})^+$;
l is an integer of 0–2;
n is an integer of 0–4;
m is an integer of 0 or 1;
$R_3$ is —H, —OH or

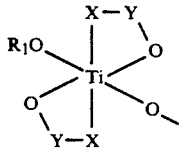

wherein X, Y, $R_1$, l and Z are as defined above;
$R_4$, $R_5$, $R_6$, and $R_7$ independently represent —H, —OH or —$OR_8$;
$R_8$ represents pyran or furan;
$R_9$, $R_{10}$, $R_{11}$ and $R_{12}$ independently represent H or an alkyl of 1–4 carbons.

DETAILED DESCRIPTION OF THE INVENTION

Titanium complexes defined by Formula 1 are advantageous as described herein when added to a photographic silver halide emulsion. The titanium complexes are preferably added in an amount up to 1.0 gram of titanium complex per 100 grams of gelatin. More preferred is an amount of 0.0001 to 1.0 gram of titanium complex per 100 grams of gelatin and most prefered is an amount of 0.050 to 0.75 grams of titanium complex per 100 grams of gelatin. An amount over 1.0 gram is sufficient to crosslink the gelatin, as known in the art but is in excess of the amount necessary to improve the image color.

In Formula I, it is understood that for the $R_1$, and $R_2$ definitions the alkyl group can be unsubstituted or substituted. Also, for the $R_8$ definition the pyran or furan groups can likewise be unsubstituted or substituted. For the Y definition which is a linear bridging group of 2 to 6 carbons, such group can be unsubstituted or substituted with for example —OH or side chains of alkyl, carboxyl or phenyl.

Particular preferred examples are obtained when X and Y are the elements necessary to form the salt of lactic acid, glycolic acid, malic acid, citric acid,, tartaric acid, saccharic acid, gluconic acid, glyceric acid or mandelic acid and when R1 or R2 represent the elements necessary to form glycerol, erythritol, arabitol, xylitol, sorbitol, dulcitol, mannitol, inositol, glucose, fructose, mannose, galactose, xylose, sucrose, lactose, maltose or cellobiose.

Addition can be accomplished at any point prior to coating of the emulsion with the most preferred time of addition being after chemical and spectral sensitization and prior to coating. Aqueous solutions are the preferred addition mode yet any suitable solvent is acceptable provided the solvent does not itself alter the properties of the photographic element. The advantage of this invention is most readily realized in a negative working silver halide photographic element with the advantage being an improvement in the color of the elemental silver which reproduces the image as a continuum of silver coating density.

Optical human visualization of the image color for an exposed photographic negative element is dependant on a variety of subjective and objective factors as described in U.S. Pat. No. 4,933,269 and are therefore best determined using the relationships established by the Commission Internationale de l'Eclairage. A practical formula known as the CIE 1976 (L*a*b*)—space defines the color as a function of three parameters wherein L* defines the perceived lightness with a greater value indicating a lighter tone, a* defines the hue along a green-red axis with negative values indicating more green hue and positive values indicating more red hue, and b* which defines a yellow-blue axis with negative values indicating more blue hue and positive values indicating more yellow hue. A more detailed description of the CIE 1976 (L*a*b*)—space can be found in G. Wyszecki & W. S. Stiles, *Color Science Concepts and Methods, Quantitative Data and Formulae*, J. Wiley & Sons, N.Y. (1982). Under the CIE 1976 (L*a*b*)—space system a preferable image color for a negative silver halide element is one with the lowest possible b* value or one which has the least amount of yellow component to the resulting image. For demonstrating the teachings of this invention a red sensitive recording element was exposed in a LINX ® camera, as known in the art, to a predetermined density. Processing was then accomplished as known in the art, followed by testing of the image color in accordance with the CIE 1976 (L*a*b*) procedure. For convenience, and accuracy, the photographic emulsion was removed from the substrate with bleach and the substrate image color was measured. This allowed the contribution from the substrate to be subtracted and therefore, the image color reported herein are for the photographic emulsion only and do not contain a contribution from a substrate.

Tabular grain silver halide products are well-known in the art and present the user with some considerable advantages over conventional grain products. The tabular grains can usually be coated at a much thinner coating weight without loss of covering power. Tabular chloride emulsions are also well-known and are described by Maskasky in U.S. Pat. No. 4,400,463, and also by Wey, U.S. Pat. No. 4,399,205. References which describe the manufacture and use of tabular grain elements are Dickerson, U.S. Pat. No. 4,414,304; Wilgus et al., U.S. Pat. No. 4,434,226; Kofron et al., U.S. Pat. No. 4,439,520; Nottorf, U.S. Pat. No. 4,722,886; and Ellis, U.S. Pat. No. 4,801,522. Tabular grains are typically defined by the shape which comprises two major parallel faces. The ratio of a circle, with the same surface area as one of the major parallel faces, to the thickness of the grain is referred to in the art as the aspect ratio. A tabular grain is defined as a grain with an aspect ratio of greater than about 1.0 and preferably greater than about 2.0 and most preferably greater than about 3.0.

The term "gelatin" as used herein is used interchangably with the term "hydrophilic colloid" both of which refer to the protein substances which are derived from collagen. In the context of the present invention "gelatin" also refers to substantially equivalent substances such as synthetic analogues of gelatin. Generally gelatin is classified as alkaline gelatin, acidic gelatin or enzymatic gelatin. Alkaline gelatin is obtained from the treatment of collagen with a base such as calcium hydroxide, for example. Acidic gelatin is that which is obtained from the treatment of collagen in acid such as, for example, hydrochloric acid and enzymatic gelatin is generated with a hydrolase treatment of collagen. The teachings of the present invention are not restricted to gelatin type or the molecular weight of the gelatin.

The temperature at which a gelatin melts is an indicator of the efficiency with which the gelatin is hardened. Increased meltpoint corresponds to a harder gelatin with more internal bonding in the gelatin structure. The melt point is typically measured by coating a gelatin containing solution (or photosensitive emulsion) onto a substrate and drying as known in the art. The substrate is then submersed in a 10% NaOH solution at room temperature and the solution is heated slowly until the coated gelatin begans to melt. The melt point is determined as the temperature of the NaOH solution that causes the coated gelatin to melt.

Photographic elements which may be considered applicable to the teachings herein include, but are not limited to, positive and negative working systems. Other adjuvants may be added to the photographic emulsion as known in the art including, but not limited to, chemical and spectral sensitizers, brighteners, antifoggants and stabilizers, color materials, light scattering and absorbing materials, other binder additives, other hardeners, coating aids, plasticizers and lubricants, antistatic agents and layers, matting agents, development agents, development modifiers and the like as detailed in *Research Disclosure*, December 1989, Item 308119. It is typical to coat the photographic emulsion on a suitable support, followed by drying, exposing, processing and the like as reviewed in detail in *Research Disclosure*, December 1989, Item 308119.

This invention will now be further described by the following examples which are not intended to limit the invention in any way:

Titanium complexes in accordance with this invention may be prepared as detailed in U.S. Pat. No. 4,609,479. Complex H-1 may be purchased from E. I. duPont de Nemours and Company, Wilmington Del. under the name of Tyzor ® LA or prepared as known in the art.

Preparation of H-2

D,l-malic acid (40.2 g) and sorbitol (21.6 g) would be dissolved in deionized water (108 g) and swept slowly with nitrogen. At 23°-25°, $TiCl_4$ (57 g) would be added dropwise over a 70 minute period with continued stirring at 23°-25°, for an additional 30 minutes. Aqueous NaOH (226.2 g of 30.3% solution) would be added dropwise at 25°-27° over a period of approximately 82 minutes.

Preparation of H-3

Sorbitol (27.3 g) and lactic acid (30.4 g of an 88.8% aqueous solution) would be dissolved in deionized water (108 g) and swept slowly with nitrogen. Titanium tetrachloride (57 g) would be added dropwise over a period of approximately 35 minutes at a temperature of 22°-26°. After 30 minutes of additional stirring at 25° and aqueous sodium hydroxide solution (191.9 g of a 30.3% solution) would be added dropwise over a period of approximately 1 hour and 46 minutes at 21°-26° to a pH of 7.2.

EXAMPLE 1

A photographic emulsion comprising tabular grains as detailed in U.S. Pat. No. 4,801,522 was prepared and chemically sensitized. The emulsion was subjected to spectral sensitization with the known red sensitizing dye:

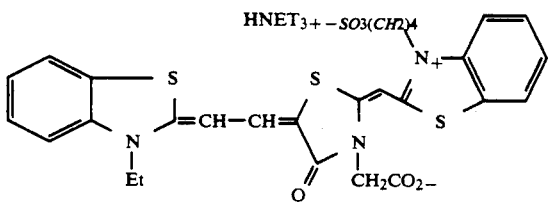

The titanium complexes were added either alone or with formaldahyde (C-1) and the gelatin was further hardened with chromealum (C-2) in the amounts shown in the following table. The melt point (MP) and image color were measured as described above.

TABLE 1

| | Hardener | | Titanium | | | |
|---|---|---|---|---|---|---|
| Sample | Type | % Hard | Complex | % Hard | MP | Color |
| 1 Comp. | C-1/C-2 | 0.80/1.10 | — | — | 32 | 7.4 |
| 2 Inv. | C-1/C-2 | 0.80/1.10 | H-1 | 0.064 | 32 | 6.5 |
| 3 Inv. | C-1/C-2 | 0.80/1.10 | H-1 | 0.64 | 30 | 5.0 |
| 4 Inv. | C-1/C-2 | 0.80/1.10 | H-2 | 0.064 | 30 | 7.2 |
| 5 Inv. | C-1/C-2 | 0.80/1.10 | H-2 | 0.64 | 30 | 6.6 |
| 6 Inv. | C-1/C-2 | 0.80/1.10 | H-3 | 0.064 | 30 | 7.2 |
| 7 Inv. | C-1/C-2 | 0.80/1.10 | H-3 | 0.64 | 32 | 6.0 |
| 8 Comp. | C-1 | 0.80 | — | — | 30 | 6.8 |
| 9 Inv. | C-1 | 0.80 | H-1 | 0.64 | 30 | 4.4 |
| 10 Inv. | C-1 | 0.80 | H-2 | 0.64 | 34 | 6.5 |
| 11 Inv. | C-1 | 0.80 | H-3 | 0.64 | 33 | 6.4 |
| 12 Comp. | C-1 | 1.10 | — | — | 39 | 5.6 |
| 13 Inv. | C-1 | 1.10 | H-1 | 0.064 | 43 | 5.6 |
| 13 Inv. | C-1 | 1.10 | H-1 | 0.64 | 38 | 4.3 |

Samples comprising titanium complexes in accordance with the teachings herein provide an improved image color for a tabular grain emulsion as illustrated by the b* value in Table 1. These improvements are observed with minimal effect on meltpoint. Sample 1 is a comparative sample, which is void of a titanium complex and has a b* valure of 7.4. As titanium complexes are added as in inventive samples 2 through 7 the image color, as measured by b*, is improved dramatically. Analogous results are observed when the sample is void of chromealum as illustrated in samples 8 through 14.

EXAMPLE 2

A comparative photographic emulsion was prepared substantially identical to that described in Example 1 except for the replacement of the tabular grain with a cubic grain and the use of the known red sensitizing dye:

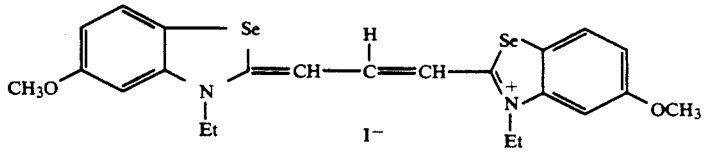

The emulsion was treated as described for Example 1 and the data recorded in Table 2.

TABLE 2

| | Hardener | | Titanium | | |
|---|---|---|---|---|---|
| Sample | Type | % Hard | Complex | % Hard | Color |
| 1 Comp. | C-1/C-2 | 1.50/0.80 | — | — | 4.4 |
| 2 Comp. | C-1/C-2 | 0.50/0.80 | H-1 | 0.62 | 4.4 |
| 3 Comp. | C-1/C-2 | 1.75/0.80 | — | — | 4.2 |
| 4 Comp. | C-1/C-2 | 1.75/0.80 | H-1 | 0.62 | 4.2 |

In the absence of tabular grains the improvements in image color derived from titanium complexes as taught herein are not observed.

We claim as our invention:

1. A photographic element comprising;

(a) at least one silver halide photosensitive layer comprising tabular grains;

(b) a hydrophilic colloid;

(c) at least one titanium complex in the amount of 0.0001 to 1.0 grams per 100 grams of said hydrophilic colloid wherein said titanium complex is defined as

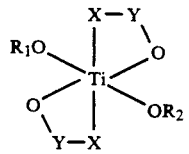

1Z wherein $R_1$ and $R_2$ independently represent H, an alkyl group of 1 to 10 carbons, $$-CH_2(CHOH)_nCH_2-R_3$$

or

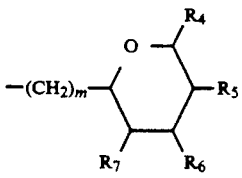

Y is a linear bridging group of 2 to 6 carbons;

X is O or N;

Z is $(NR_9R_{10}R_{11}R_{12})^+$;

l is an integer of 0-2;

n is an integer of 0-4;

m is an integer of 0 or 1;

$R_3$ is —H, —OH or

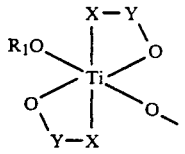

wherein X, Y, and $R_1$ are as defined above;

$R_4$, $R_5$, $R_6$, and $R_7$ independently represent —H, —OH or —$OR_8$;

$OR_8$;

$R_8$ represents pyran or furan;

$R_9$, $R_{10}$, $R_{11}$ and $R_{12}$ independently represent H or an alkyl of 1–4 carbons.

2. The photographic element recited in claim 1 wherein the titanium complex is present in the amount of 0.050 to 0.75 grams of titanium complex per 100 grams of said hydrophilic colloid.

3. The photographic element recited in claim 1 wherein X and Y are the elements necessary to form the salt of lactic acid, glycolic acid, malic acid, citric acid, tartaric acid, saccharic acid, gluconic acid, glyceric acid or mandelic acid.

4. The photographic element recited in claim 1 wherein R1 or R2 represents the elements necessary to form glycerol, erythritol, arabitol, xylitol, sorbitol, dulcitol, mannitol, inositol, glucose, fructose, mannose, galactose, xylose, sucrose, lactose, maltose or cellobiose.

5. The photographic element recited in claim 1 wherein X and Y are the elements necessary to form —CO—$CH(CH_3)O$— or —$COCH_2CH(OH)CO_2$—.

6. The photographic element recited in claim 1 wherein $R_1$ or $R_2$ is hydrogen or —$CH_2(CHOH)_4CH_2OH$.

* * * * *